US006285128B1

(12) United States Patent
Amemiya

(10) Patent No.: US 6,285,128 B1
(45) Date of Patent: Sep. 4, 2001

(54) SURFACE DISCHARGE TYPE PLASMA DISPLAY PANEL

(75) Inventor: Kimio Amemiya, Yamanashi-ken (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/209,776

(22) Filed: Dec. 11, 1998

(30) Foreign Application Priority Data

Dec. 19, 1997 (JP) ..... 9-365427

(51) Int. Cl.[7] ..... H01J 17/49
(52) U.S. Cl. ..... 313/582; 445/24
(58) Field of Search ..... 313/581–587; 445/24

(56) References Cited

U.S. PATENT DOCUMENTS 5,684,362 * 11/1997 Togawa ..... 313/582
5,952,782 * 9/1999 Nanto et al. ..... 313/584

* cited by examiner

*Primary Examiner*—Ashok Patel
*Assistant Examiner*—Matt Gerike
(74) *Attorney, Agent, or Firm*—Arent Fox Kintner Plotkin & Kahn, PLLC

(57) ABSTRACT

A surface discharge type plasma display panel is comprised of a plurality of discharge maintaining electrodes extending in parallel with displaying lines, and a plurality of address electrodes extending perpendicular to the discharge maintaining electrodes. One important feature of the display panel is that at least one dummy electrode is provided on a non-displaying area outside an outmost electrode of the above address electrodes, in a manner such that the dummy electrode is adjacent to and in parallel with said outmost address electrode and is electrically connected to the outmost address electrode by means of connecting conductors.

5 Claims, 5 Drawing Sheets

SURFACE DISCHARGE TYPE PLASMA DISPLAY PANEL

BACKGROUND OF THE INVENTION

The present invention relates to a surface discharge type plasma display panel, particularly to a surface discharge type plasma display panel (hereinafter simply referred to as PDP) whose discharge cells are arranged in matrix manner.

FIG. 5 is a plane view illustrating a basic structure of a surface discharge type PDP made according to a prior art. As shown in FIG. 5, a conventional surface discharge type PDP comprises a pair of glass substrate plates 11, 21 facing each other and forming a discharge space therebetween. Such discharge space has a thickness of 100–200 $\mu$m and is formed by sealing together entire edge portions of the two glass substrate plates 11, 21. With such surface discharge type PDP having discharge cells arranged in a matrix manner, a plurality of row electrodes are arranged orthogonal to a plurality of column electrodes so that a displaying area EH is formed.

However, referring to FIG. 5, since a peripheral sealing material 31 positioned along the above edge portions will undesirably produces a gas during an electric discharge, the electric discharge within the discharge space is not stable in the vicinity of these sealed edge portions. To cope with this problem in order to ensure a stable electric discharge, it has been suggested that a non-displaying area EN be provided surrounding the displaying area EH. Usually, such non-displaying area EN has a width of 20 mm regardless of a size of a picture plane.

In more detail, a surface discharge type PDP has a plurality of display electrodes X,Y defining main discharge cells (surface discharge cells), a plurality of address electrodes A which together with the display electrodes Y serve to form selective discharge cells, and a plurality of strap-like partition walls 29 for dividing the discharge space within the displaying area EH into a plurality of smaller sections in the direction of displaying lines.

In fact, the display electrodes X,Y are covered by a dielectric layer (not shown in FIG. 5, but is used for AC driving the PDP using wall electric charges) in the discharge space. In practice, each pair of the display electrodes X,Y serve as a discharge maintaining electrode pair on each displaying line.

In use of the above surface discharge type PDP, a write-in address method or an erase address method is utilized to selectively accumulate wall charges in main discharge cells (to be lighted), so as to alternatively apply a discharge maintaining voltage to the display electrodes X,Y, thereby periodically causing a desired surface discharge (in a direction along the surfaces of the substrate plates) A displaying brightness may be adjusted by selecting the number of discharge times within each unit time.

However, the above surface discharge type PDP has been found to have at least one problem which will be described in detail below.

Namely, when a scanning pulse is applied to the discharge maintaining electrodes and at the same time an address pulse is applied to the address electrodes in accordance with display data, selective discharge will happen within discharge cells (to be lighted) and wall charges are accumulated. At this moment, since an electric field intensity obtained by an address potential of the address electrodes on the outmost sides will become weak, it will be difficult for the desired selective discharge to occur, resulting in a decrease of an address margin.

SUMMARY OF THE INVENTION

It is an object of the present invention to provide an improved surface discharge type PDP capable of preventing a decrease of an address margin on the outmost side of a displaying area, so as to solve the above-mentioned problems peculiar to the above-mentioned prior art.

According to the present invention, there is provided a surface discharge type plasma display panel having a plurality of discharge maintaining electrodes extending in parallel with displaying lines, and a plurality of address electrodes extending perpendicular to the discharge maintaining electrodes, characterized in that at least one dummy electrode is provided on a non-displaying area outside an outmost electrode of the above address electrodes, in a manner such that the dummy electrode is adjacent to and in parallel with said outmost address electrode and is electrically connected to the outmost address electrode by means of connecting conductors.

In one aspect of the present invention, the at least one dummy electrode has the same width as each address electrode and has a sufficient length capable of intersecting with all the discharge maintaining electrodes.

In another aspect of the present invention, the at least one dummy electrode and the connecting conductors, are formed at the same time when forming the address electrodes, using a film formation process in which a silver paste is printed followed by calcination.

In further aspect of the present invention, on a displaying area the plurality of discharge maintaining electrodes are each formed by a large width transparent conductive film and a narrow width metal film, while on the non-displaying area the plurality of discharge maintaining electrodes are each formed only by metal film.

In a still further aspect of the present invention, a discharge gap between each discharge maintaining electrode pair on the non-displaying area has a larger width than 'that on the displaying area.

The above objects and features of the present invention will become better understood from the following description with reference to the accompanying drawings.

DETAILED DESCRIPTION OF THE PREFERRED EMBODIMENT

Figure 1:
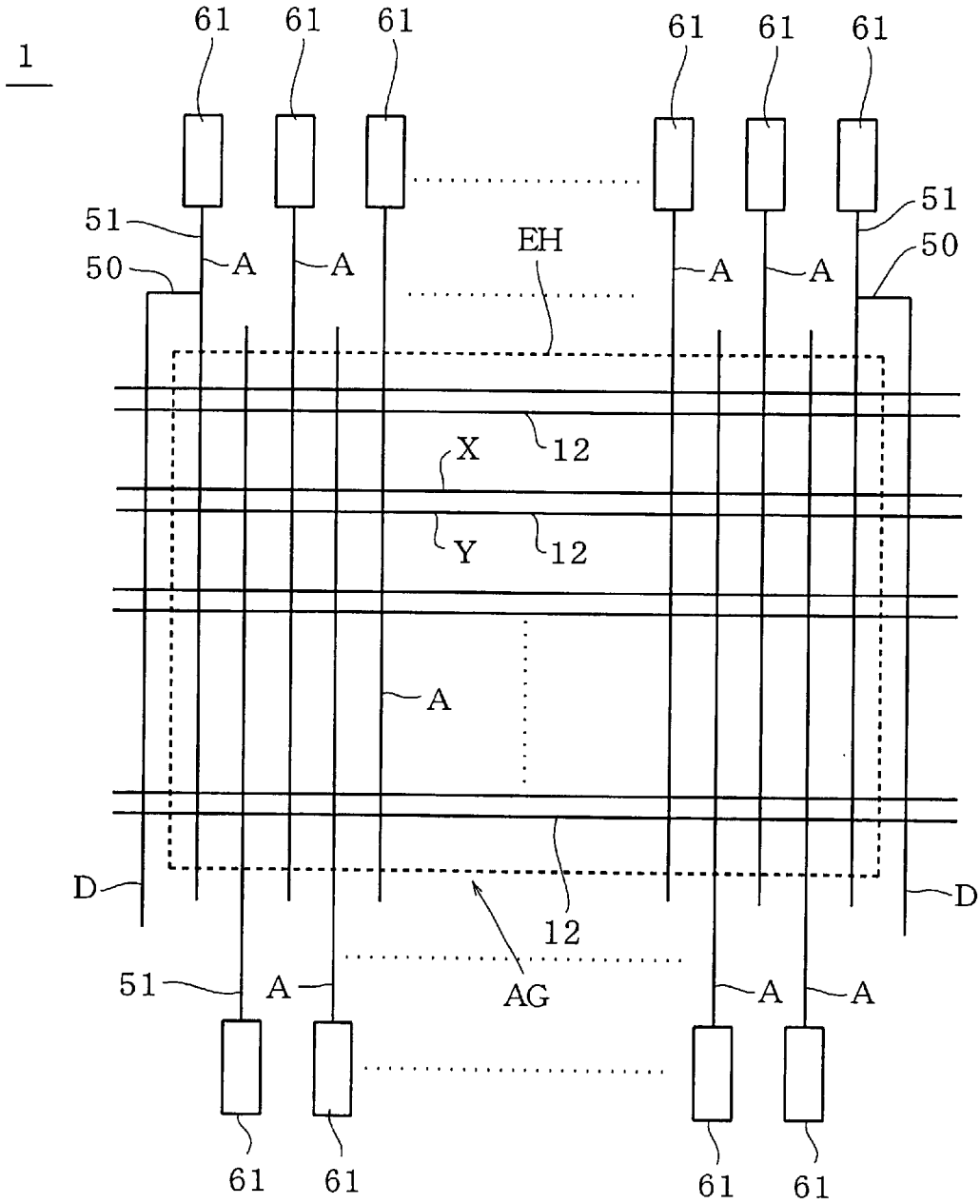
FIG. 1 is a plane view schematically illustrating the structure of a surface discharge type PDP made according to the present invention.

In the following description of preferred embodiment of the present invention, the elements which are the same as those used in the above prior art will be represented by the same reference numerals, and similar descriptions thereof will be omitted.

FIG. 1 is a plane view schematically illustrating the structure of a surface discharge type PDP made according to the present invention. Referring to FIG. 1, a surface discharge type PDP of the present invention involves the use of three kinds of electrodes including display electrodes X,Y (forming discharge maintaining electrodes 12) and address electrodes A for each unit luminescent area. An area where the display electrodes X,Y are intersected with the address electrodes A are referred to as displaying area EH.

As shown in FIG. 1, the address electrodes A are alternatively extended on upper and lower sides (when viewed in FIG. 1), with each extended end being connected with an external terminal 61.

In order to prevent a decrease in an electric field intensity (obtained by an address potential of address electrodes on the outmost sides of the displaying area EH), a pair of dummy electrodes D,D are provided adjacent to and parallel with the corresponding outmost address electrodes A of an address electrode group AG. In detail, each dummy electrode D has the same width as each address electrode A and has a sufficient length capable of intersecting with all the discharge maintaining electrodes 12. Further, each dummy electrode D is connected to an adjacent external terminal 61 through a connecting conductor 50 and another connecting conductor 51.

Such dummy electrodes D and the connecting conductors 50 and 51, are formed at the same time when the address electrodes A are formed, using a film formation method in which a silver paste is printed followed by calcination.

In this way, since a pair of dummy electrodes D,D are provided adjacent to and parallel with the corresponding outmost address electrodes A of the address electrode group AG, the calcining conditions on the edge portions and on the central portion of the address electrode group AG will be substantially the same during a process of calcining the address electrodes A, thereby ensuring the formation of an address electrode group AG having a uniform calcinated state.

Figure 2:
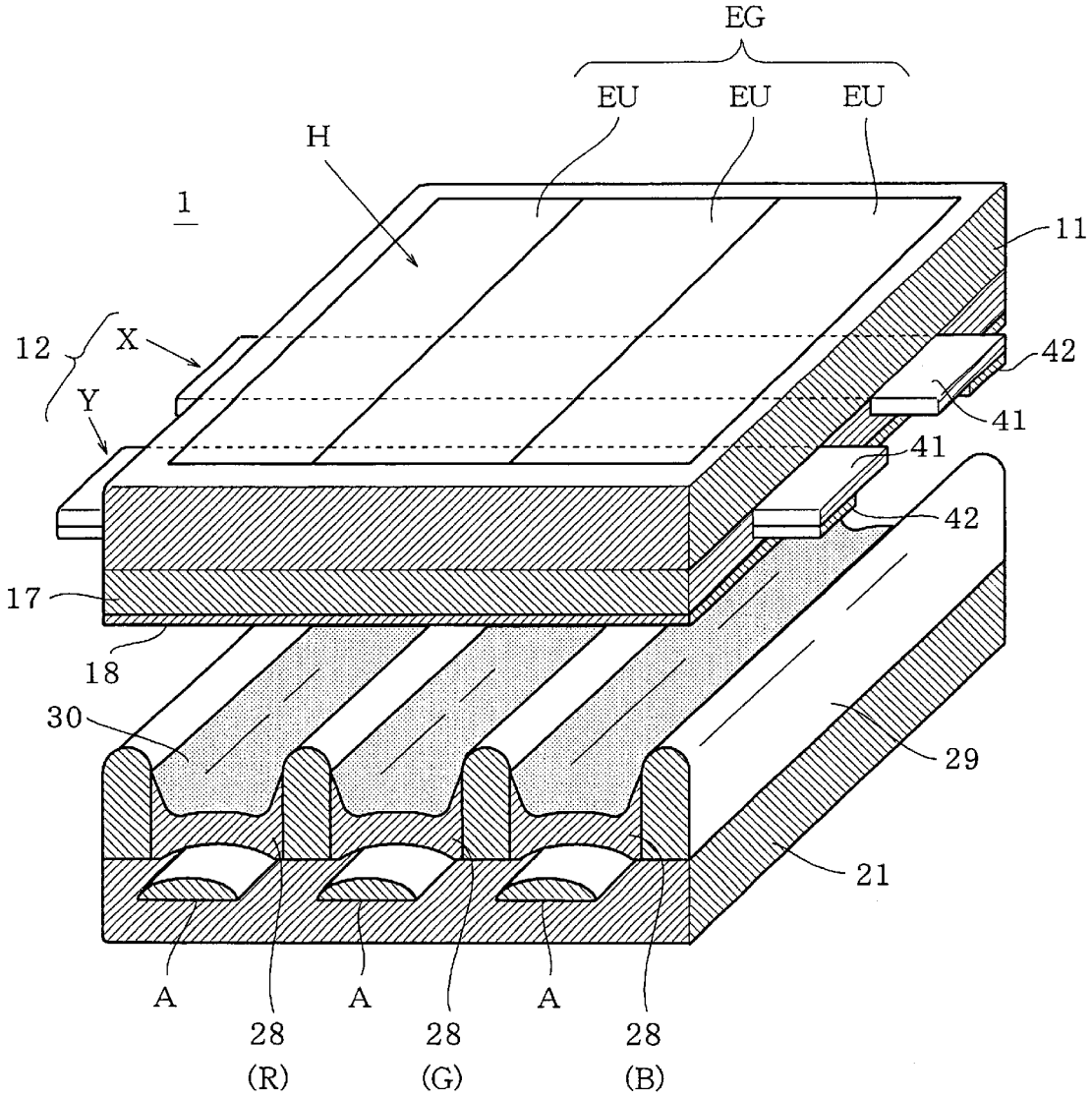
FIG. 2 is an exploded perspective view schematically illustrating a part of the PDP corresponding to one picture element of the surface discharge type PDP shown in FIG. 1.

FIG. 2 is an exploded perspective view schematically illustrating the structure of a part of the PDP corresponding to one picture element of the surface discharge type PDP shown in FIG. 1. As shown in FIG. 2, the display electrodes X,Y forming the discharge maintaining electrodes 12 are provided on the inner surface of a front glass substrate plate 11, and are covered by a dielectric layer 17 having a thickness of 20–30 $\mu$m within the discharge space 30. Further, the dielectric layer 17 is formed on its surface with a protection layer 18 which is a MgO film having a thickness of several thousand Angstroms.

In order to effect a surface discharge in an area as large as possible and at the same time to minimize a blocked amount of displaying light, on the displaying area EH the display electrodes X,Y are formed by transparent conductive films 41 each consisting of nesa film having a large width, and metal films 42 each having a narrow width for supplementing an electric conductivity. However, on non-displaying areas outside the displaying area EH, there are not formed any transparent conductive films 41. Namely, display electrodes X,Y on these areas are formed only by metal films 42, obtaining a larger discharge gap between each display electrode pair X,Y than that on the displaying area EH.

On the other hand, the address electrodes A (each having a width of 50–100 $\mu$m) for selectively lumining a plurality of unit luminescent areas EU, are provided on the inner surface of a rear glass substrate 21. A plurality of strap-like partition walls 29 each having a height of 100–200 $\mu$m are provided between the address electrodes A. In this manner, the discharge space 30 is divided (along the extending direction of the display electrodes X,Y) into a plurality of smaller sections each corresponding to one unit luminescent area.

Further, a plurality of fluorescent layers 28(R), 28(G), 28(B) are disposed in the discharge space 30 to cover the address electrodes A and the side wall portions of the partitions 29.

The surface discharge type PDP I constructed in the above-described manner, is called reflective type display panel in view of the arranging manner of the fluorescent layer 28. The fluorescent layer 28 is capable of luminescing upon being exited by an ultraviolet light produced from a discharge gas during a process of surface discharge.

Each picture element (picture cell) EG comprises three unit luminescent areas (sub picture cells) having identical sizes to one another and arranged in displaying line direction. For example, if a picture is comprised of 640×480 picture elements (picture cells), each of 480 displaying lines is comprised of 640×3 unit luminescent areas (sub picture cells).

In each unit luminescent area EU, a pair of display electrodes X, Y are used to define a surface discharge cell (a main discharge cell for displaying), a display electrode Y and an address electrode A are used to define an address discharge cell for selecting displaying or non-displaying. In this way, the fluorescent layers 28(R), 28(G), 28(B) extending parallel to the address electrodes A, may be partially and selectively lumined corresponding to each unit luminescent area EU, thereby effecting a desired full color displaying.

The surface discharge type PDP I may be driven with the use of a write-in address method and an erase address method.

Figure 3:
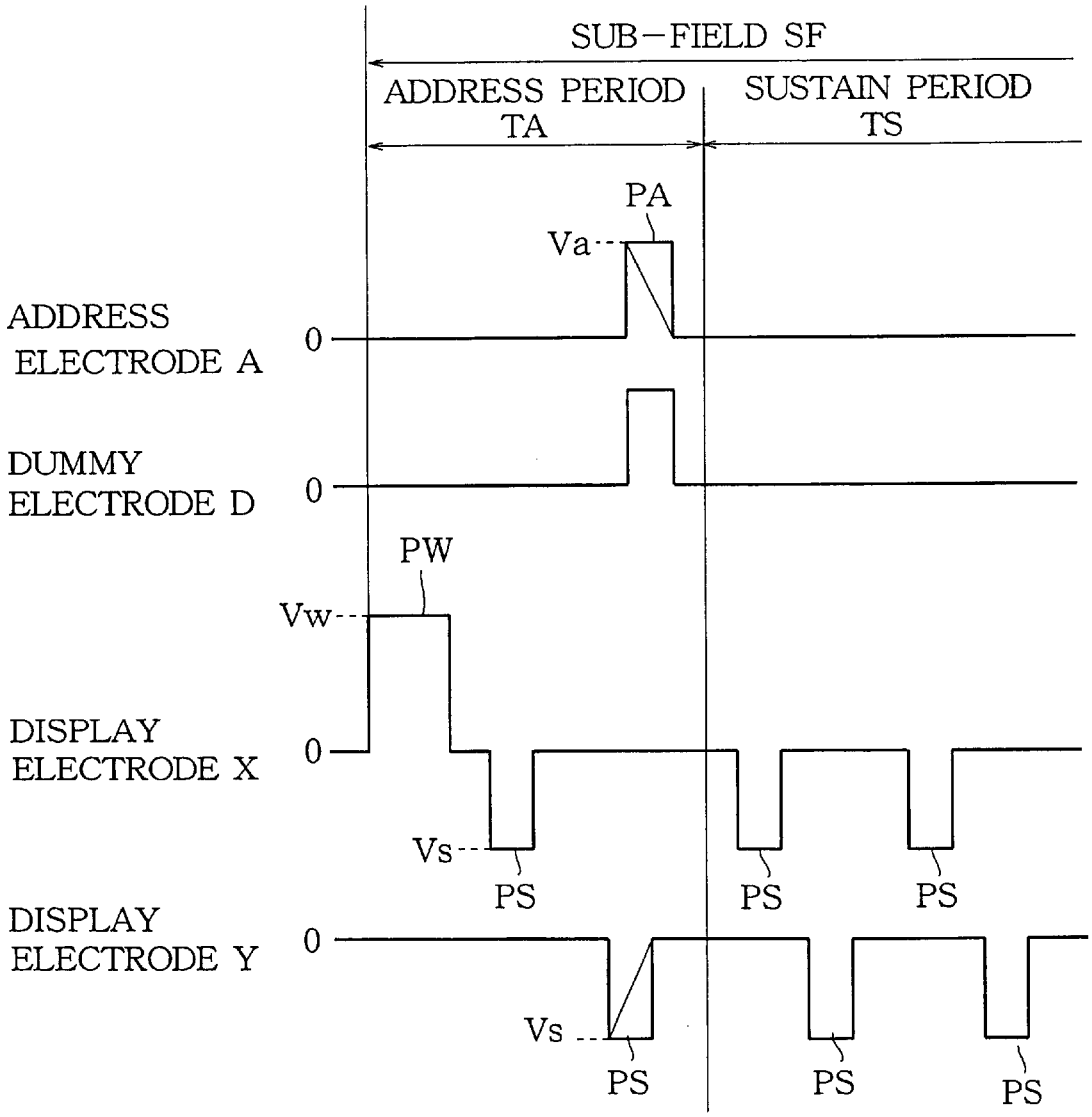
FIG. 3 is a graph indicating a wave shape of applied voltages for driving the surface discharge type PDP with the use of a write-in address method.

FIG. 3 is a graph indicating the wave shape of applied voltages for driving the surface discharge type PDP I with the use of a write-in address method. As shown in FIG. 3, a sub-field SF formed by finely dividing a picture displaying period (frame) for performing tonal displaying, is divided into an address period TA which is used to set lighting or non-lighting of a unit luminescent area EU in accordance with display content, and a sustain period TS for maintaining a displaying brightness.

When using a write-in address method, during an address period TA, it is needed to perform writing-in and erasing of an entire picture, so as to avoid being affected by a previous lighting condition.

For example, all of the display electrodes X are first applied with a write-in pulse PW having a positive value Vw and then applied with several sustain pulses (discharge maintaining voltages) each having a negative value Vs. Further, some of the display electrodes Y and the address electrodes A corresponding to unit luminescent areas EU (to be lumined), are applied with a sustain pulse PS and several address pulses PA, so as to effect selected discharges and thus accumulate wall electric charges having a desired polarity which are necessary for maintaining desired discharge. At this moment, the display electrodes Y are selected to be applied with the above pulses from one displaying line to another. In FIG. 3, inclined lines attached with pulse PS and pulse PA are used to indicate that the application of the above pulses are selective.

In this way, during an address period TA using the address electrodes A to perform selective write-in process, a pair of dummy electrodes D have the same potential as adjacent address electrodes A since they are electrically connected with the adjacent electrodes A. As a result, since the dummy electrodes D are contributive to the formation of an electric field needed for electrical discharge, it is allowed to prevent a possible decrease in the intensity of the electric field acting towards inside address electrodes A.

During a sustain period TS after the address period TA, a sustain pulse PS is alternatively applied to the display electrodes X,Y, so as to effect a desired surface discharge by making use of the wall charges accumulated during the write-in process. At this moment, since each discharge gap on a non-displaying area is larger than that on a displaying area, it is allowed to prohibit undesired surface discharge on non-displaying area.

Figure 4:
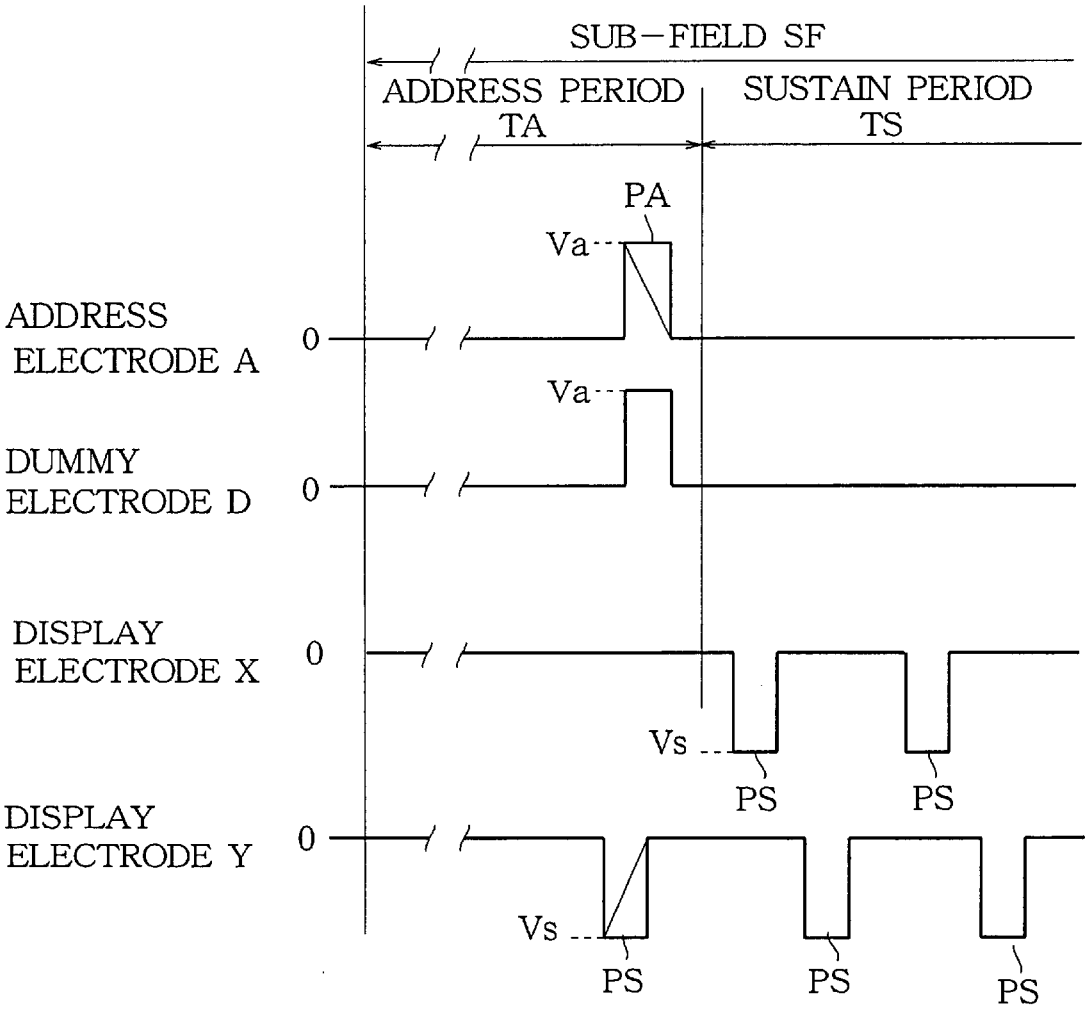
FIG. 4 is a graph indicating a wave shape of applied voltages for driving the surface discharge type PDP with the use of an erase address method.
Figure 5:
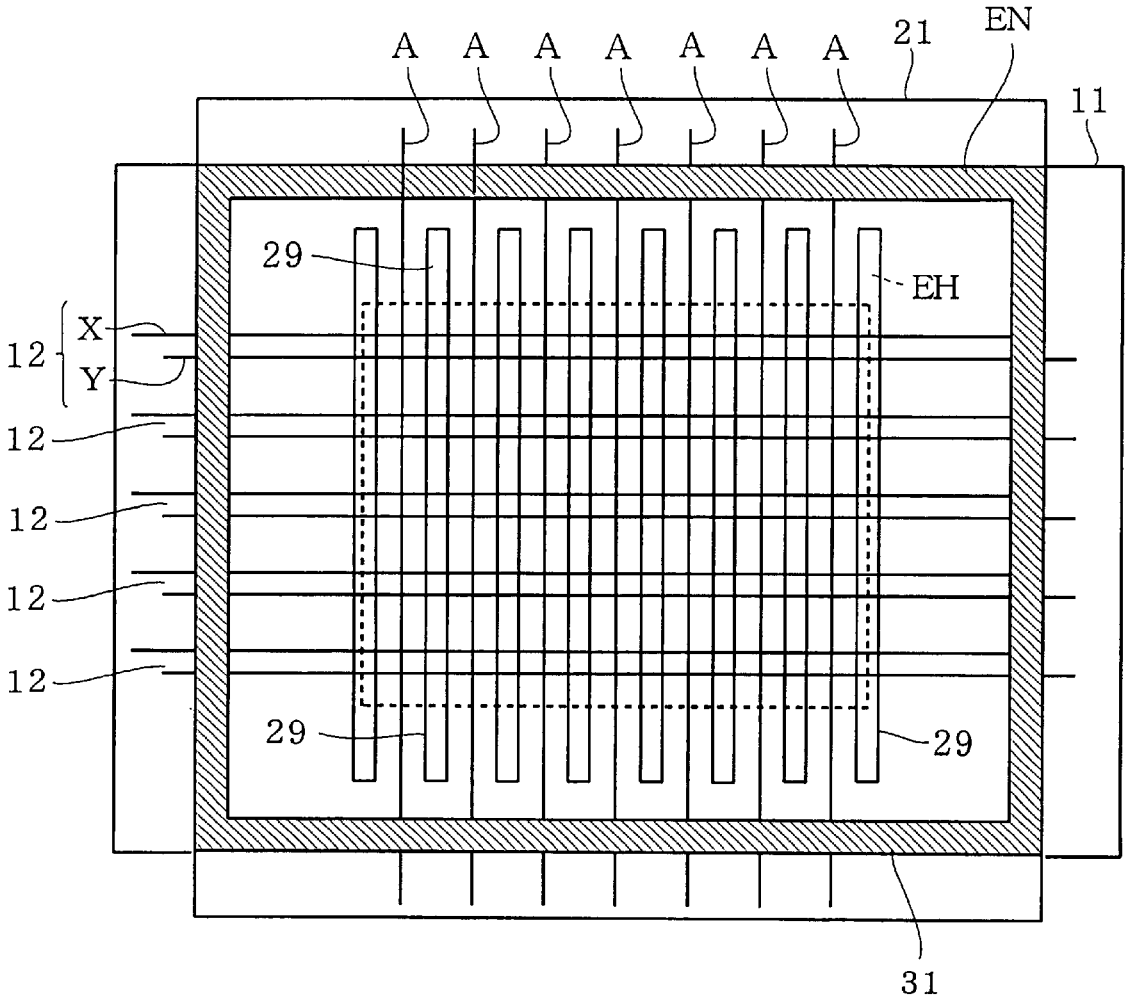
FIG.5 PRIOR ART
FIG. 5 is a plane view schematically illustrating the structure of a surface discharge type PDP made according to a prior art.

FIG. 4 is a graph indicating the wave shape of applied voltages for driving the surface discharge type PDP with the use of an erase address method.

When using an erase address method as shown in FIG. 4, during a rear-half of address period TA, a sustain pulse PS and an address pulse (erasing pulse) PA are selectively applied to the display electrodes Y and the address electrodes A, corresponding to non-lighting unit luminescent areas, in a manner just opposite to a write-in address method, thereby achieving selected discharge so as to erase unwanted wall charges.

At this time, since the pair of dummy electrodes D,D are electrically connected with the adjacent electrodes A, the dummy electrodes D,D have the same potential as adjacent address electrodes A: Namely, the erasing pulse PA is applied to the dummy electrodes D at the same timing as a pulse PA being applied to the address electrodes A. As a result, it is allowed to compensate for a possible decrease in the intensity of an electric field acting towards inside address electrodes A, by making use of a fact that the dummy electrodes D are contributive to the formation of an electric field needed for electrical discharge.

In the above embodiment of the present invention, since the pair of dummy electrodes D are disposed adjacent to the address electrodes A at the same pitch as that between the address electrodes A, and since the dummy electrodes D are electrically connected to the outmost address electrodes A, it is not necessary to generate a specific control voltage.

As may be understood from the above description, in accordance with the present invention, a pair of dummy electrodes D,D have been provided on non-displaying areas outside the outmost address electrodes A, adjacent to and in parallel with the outmost address electrodes A. In fact, the dummy electrodes D are electrically connected to the outmost address electrodes D. Therefore, it is allowed to prohibit a possible decrease in the intensity of an electric field acting towards inside address electrodes A, thereby improving the address margin on the outmost portions of the displaying area.

While the presently preferred embodiments of the this invention have been shown and described above, it is to be understood that these: disclosures are for the purpose of illustration and that various changes and modifications may be made without departing from the scope of the invention as set forth in the appended claims.

What is claimed is:

1. A surface discharge type plasma display panel having a plurality of discharge maintaining electrodes extending in parallel with displaying lines, and a plurality of address electrodes extending perpendicular to the discharge maintaining electrodes, characterized in that at least one dummy electrode is provided on a non-displaying area outside an outmost electrode of the above address electrodes, in a manner such that the dummy electrode is adjacent to and in parallel with said outmost address electrode and is electrically connected to the outmost address electrode by means of connecting conductors.

2. A surface discharge type plasma display panel according to claim 1, wherein the at least one dummy electrode has the same width as each address electrode and has a sufficient length capable of intersecting with all the discharge maintaining electrodes.

3. A surface discharge type plasma display panel according to claim 1, wherein the at least one dummy electrode and the connecting conductors, are formed at the same time when forming the address electrodes, using a film formation process in which a silver paste is printed followed by calcination.

4. A surface discharge type plasma display panel according to claim 1, wherein on a displaying area the plurality of discharge maintaining electrodes are each formed by a large width transparent conductive film and a narrow width metal film, while on the non-displaying area the plurality of discharge maintaining electrodes are each formed only by metal film.

5. A surface discharge type plasma display panel according to claim 1, wherein a discharge gap between each discharge maintaining electrode pair on the non-displaying area has a larger width than that on the displaying area.

* * * * *